United States Patent [19]

Stewart et al.

[11] 4,183,119

[45] Jan. 15, 1980

[54] HARNESSING DEVICE WITH GRIPPER RAILS

[75] Inventors: John H. Stewart, Needham; Leo P. Dekkers, Scituate Harbor, both of Mass.

[73] Assignee: Dennison Manufacturing Company, Framingham, Mass.

[21] Appl. No.: 905,707

[22] Filed: May 15, 1978

[51] Int. Cl.[2] ..... F16L 33/00

[52] U.S. Cl. ..... 24/16 PB; 24/255 SL

[58] Field of Search ..... 24/16 PB, 255 SL, 305 P, 24/20 TT; 248/74 PB

[56] References Cited

U.S. PATENT DOCUMENTS

| | | | |
|---|---|---|---|
| 3,102,311 | 9/1963 | Martin | 24/16 PB |
| 3,620,896 | 11/1971 | Glasgow | 24/16 PB |
| 3,653,099 | 4/1972 | Hoffman | 24/16 PB |
| 3,735,448 | 5/1973 | Waddington | 24/16 PB |
| 3,837,047 | 9/1974 | Dennman | 24/16 PB |
| 3,872,547 | 3/1975 | Caveney | 24/16 PB |
| 3,981,048 | 9/1976 | Moody | 24/16 PB |
| 4,045,843 | 9/1977 | Loose | 24/16 PB |

FOREIGN PATENT DOCUMENTS

| | | | |
|---|---|---|---|
| 602351 | 2/1960 | Italy | 24/16 PB |
| 487522 | 4/1970 | Switzerland | 248/74 PB |

*Primary Examiner*—Bernard A. Gelak
*Attorney, Agent, or Firm*—George E. Kersey

[57] ABSTRACT

A harnessing device formed by a locking head and an attached serrated strap with gripper rails. The head contains a guide channel for receiving the strap after encirclement of the items to be harnessed, and an internal locking tang. The serrated strap has side rails which are proportioned to grip the encircled items. The desired gripping action is facilitated by the inclusion of serrations on the rails.

8 Claims, 5 Drawing Figures

FIG. 1A
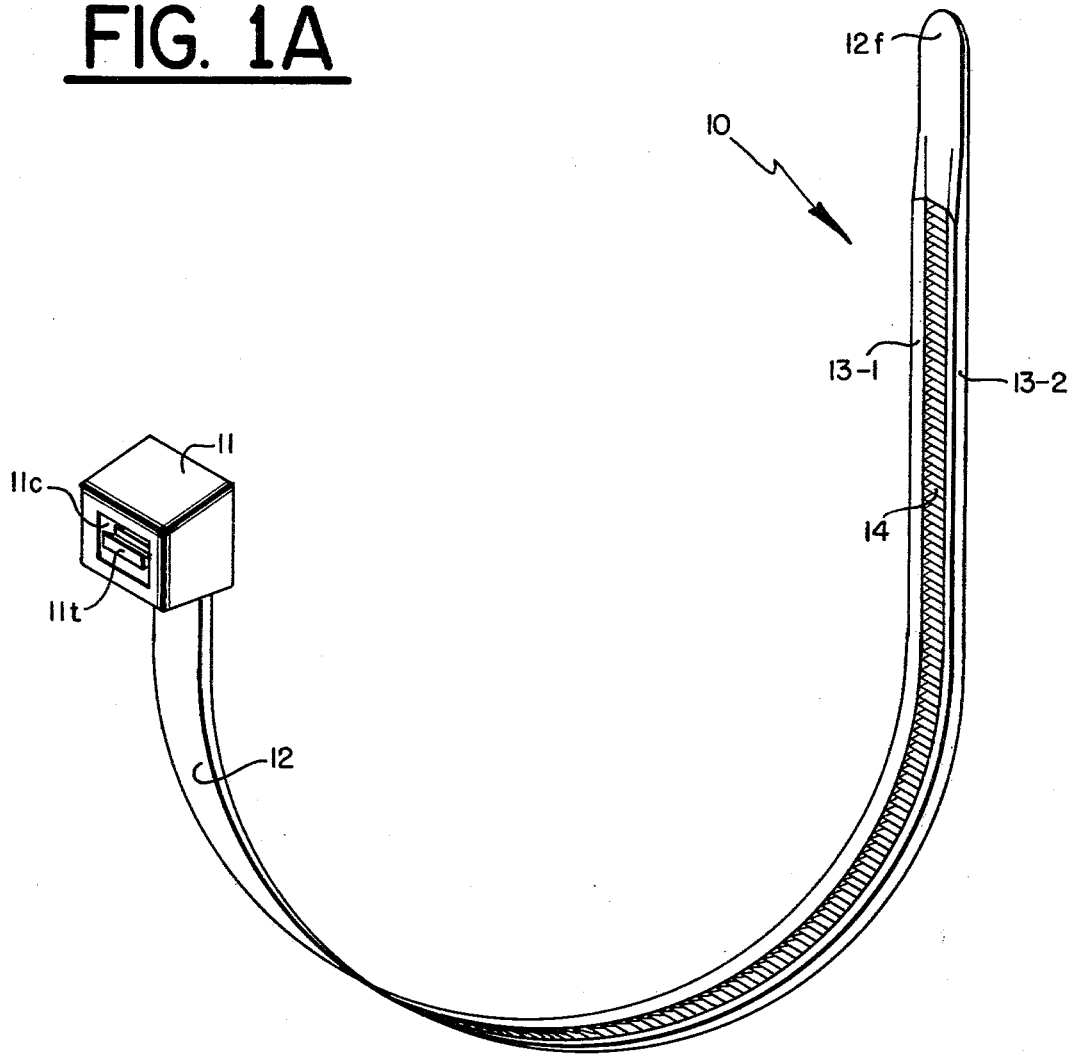
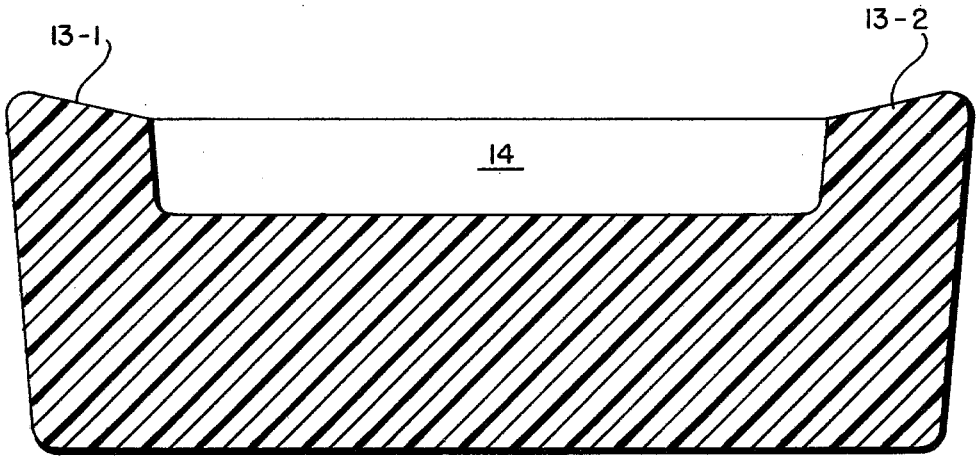
FIG. 1B

FIG. 1C
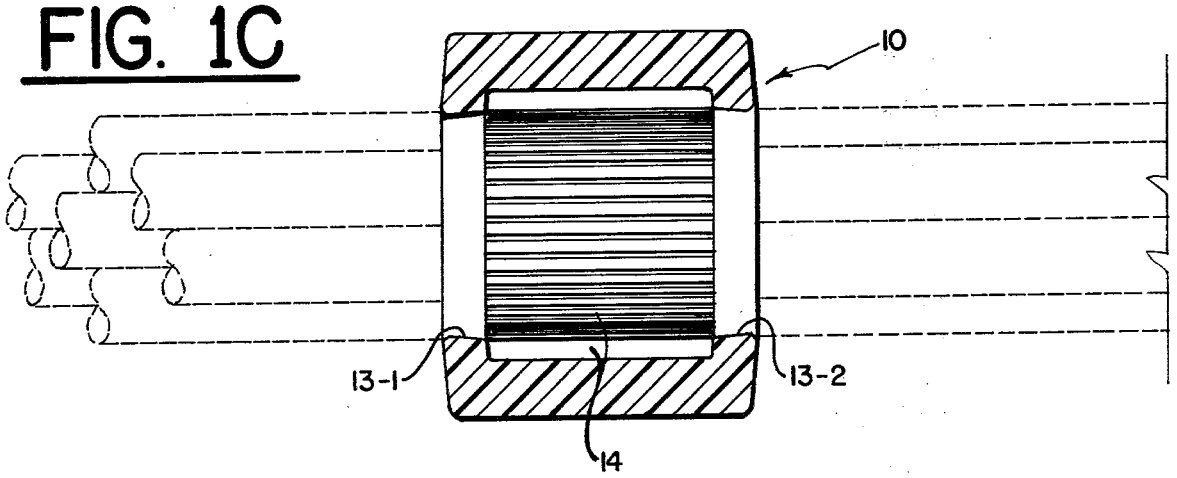
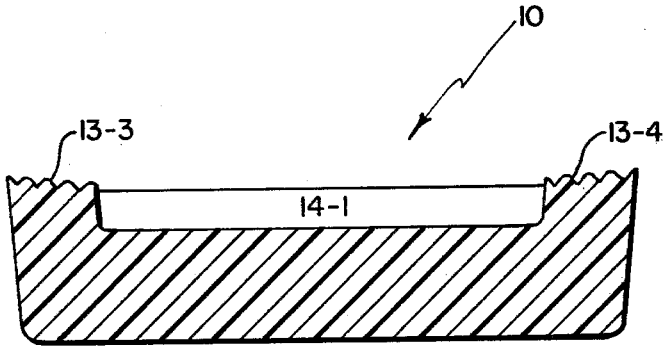
FIG. 2A
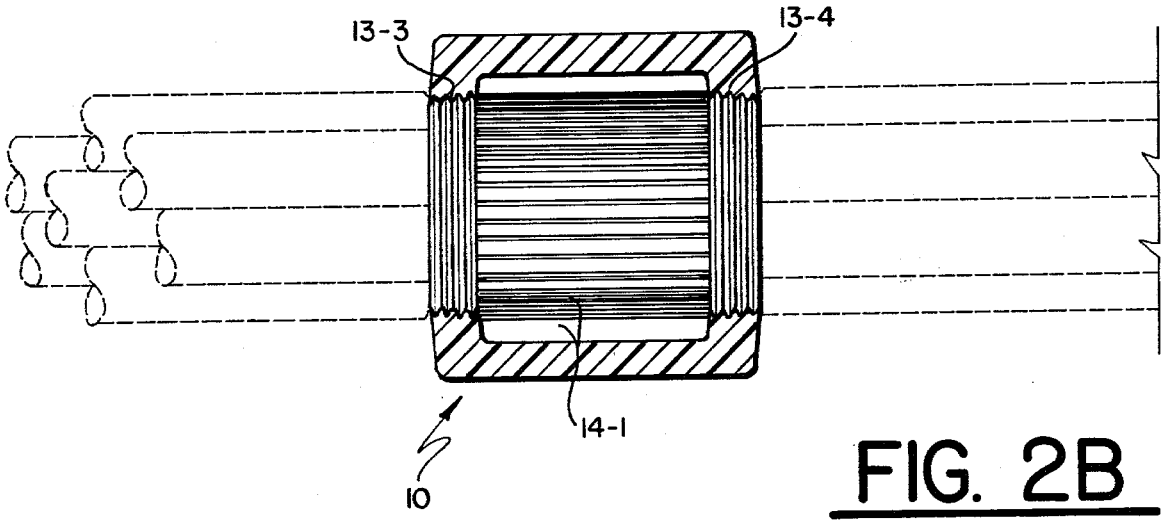
FIG. 2B

HARNESSING DEVICE WITH GRIPPER RAILS

BACKGROUND OF THE INVENTION

This invention relates to the harnessing of items and more particularly to the harnessing of items using straps and locking heads.

The harnessing devices that are in common use are formed by a strap that is insertable into an attached and apertured head which contains an internal tang that engages the strap. The strap is typically formed by a serrated central portion that is flanked by planar side rails. Because of the planar configuration of the side rails there can be slippage and undesirable translational movement of the harnessing device after the items have been encircled and the strap secured in the head.

Accordingly, it is an object of the invention to facilitate the harnessing of objects using harnessing devices. A related object is to facilitate the harnessing of objects using small scale harnessing devices.

Another object is to facilitate the insertion of straps into harnessing devices. A related object is to facilitate the insertion of straps into small scale harnessing devices.

Representative harnessing devices are disclosed in U.S. Pat. Nos. 3,816,878 (June 18, 1974); 3,766,608 (Oct. 23, 1973); 3,731,347 (May 8, 1973); 3,537,146 (Nov. 3, 1972); 3,660,869 (May 9, 1972); 3,654,669 (Apr. 11, 1972) and 3,588,962 (June 29, 1971); 3,186,047, June 1, 1962); 3,224,056 (Dec. 21, 1965); 3,486,201 (Dec. 30, 1969); 3,590,442 (July 6, 1971); 3,660,869 (May 9, 1972); 3,855,669 (Dec. 24, 1974); 3,924,299 (Dec. 9, 1975); 3,967,345 and British Pat. No. 1.201.483 (Aug. 5, 1970).

SUMMARY OF THE INVENTION

In accomplishing the foregoing and related objects, the invention provides a harnessing device in which the side rails of the device are configured to facilitate the gripping of the harnessed items. For that purpose the side rails are provided with protuberances that diverge upwardly and outwardly from the central portion of the strap. The protuberances are rounded in order to avoid damage to the items being harnessed and are asymmetric in order to provide the desired gripping action.

In accordance with one aspect of the invention, the gripping protuberances can be provided with serrations to enhance the desired gripping effect.

DESCRIPTION OF THE DRAWINGS

Other aspects of the invention will become apparent from a description of several illustrative embodiments, taken in conjunction with the drawings, in which:

FIG. 1A is a perspective view of a harnessing device in accordance with the invention;

FIG. 1B is a sectional view of the harnessing device of FIG. 1A;

FIG. 1C is a partial perspective view showing the gripping action of the device of FIG. 1A when used to harness a bundle of items;

FIG. 2A is a cross sectional view of a modified harnessing device in accordance with the invention; and FIG. 2B is a partial perspective view illustrating the gripping action of the harnessing device of FIG. 2A.

DETAILED DESCRIPTION

As shown in FIG. 1A, a harnessing device 10 in accordance with the invention includes a head 11 and an attached strap 12. The free end **12*f* of the strap 12 is insertable into a channel 11*c* of the head 11 to engage a locking tang 11*t***, which may be stationary or deflectable.

In many situations it is desirable for the harnessing device to provide a gripping effect on the items to be harnessed, without damaging those items. For that purpose the strap 12 includes side rails 13-1 and 13-2 which flank a serrated central portion of the strap 14. It will be understood that, although the strap 12 has a serrated central portion, other engagement configurations may be employed as well.

As indicated in FIG. 1B the side rails include asymmetric protuberances which diverge outwardly from the central portion of the strap thus providing gripping surfaces that facilitate the secure engagement of the encircled strap with the items to be bundled, as shown in FIG. 1C without causing damage to those items. A suitable asymmetric portuberance has an apex ratio (R) of curvature in accordance with the following formula:

$$R=L/10D$$

where L is the height of the side rail and D is the width of the side rail.

The desired gripping action in accordance with the invention is enhanced if the diverging tapered protuberances include one or more sets of serrations extending laterally along the inner walls of the gripping protuberances as indicated in FIG. 2A. The resulting engagement with a representative bundle of items is illustrated in FIG. 2B.

While various aspects of the invention have been set forth by the drawings and the specifications, it is to be understood that the foregoing detailed description is for illustration only and that various changes in parts, as well as the substitution of equivalent constituents for those shown and described, may be made without departing from the spirit and scope of the invention as set forth in the appended claims.

We claim:

1. A harnessing device comprising
   a head having a guide channel therein,
   a locking tang within said head, and
   a strap connected to said head of and having side rails, said strap having a plurallity of members between said side rails for sequentially engaging said locking tang when said strap is inserted into said channel, each side rail comprises a protuberance which diverges continuoulsy upwardly and downwardly from the central portion of said strap.

2. Apparatus as defined in claim 1 wherein said protuberances are asymmetric.

3. Apparatus as defined in claim 2 wherein each protuberance includes an apex radius of curvature in accordance with the following formula:

$$R=L/10D.$$

4. Apparatus as defined in claim 1 wherein said strap includes a central serrated portion.

5. Apparatus as defined in claim 1 wherein the locking tang is deflectable.

6. Apparatus as defined in claim 1 wherein the strap is attached to the head at an angle with respect to the axis of insertion of the strap into the channel.

7. Apparatus as defined in claim 1 wherein said protuberances form longitudinally extending serrations.

8. Apparatus as defined in the claim 7 wherein said serrations are positioned on the face of said protuberance which adjoins the central portion of said strap.

* * * * *

UNITED STATES PATENT AND TRADEMARK OFFICE

CERTIFICATE OF CORRECTION

PATENT NO. : 4,183,119

DATED : January 15, 1980

INVENTOR(S) : John H. Stewart et al

It is certified that error appears in the above—identified patent and that said Letters Patent is hereby corrected as shown below:

Column 2, line 42, after "head" cancel "of"; line 47, after "deverges" cancel "continuouslsy" and substitute -- continuously --.

Signed and Sealed this

*Eighth* Day of *July 1980*

[SEAL]

*Attest:*

SIDNEY A. DIAMOND

*Attesting Officer*

*Commissioner of Patents and Trademarks*